US005589220A

United States Patent [19]

Rapp et al.

[11] Patent Number: 5,589,220

[45] Date of Patent: *Dec. 31, 1996

[54] METHOD OF DEPOSITING CHROMIUM AND SILICON ON A METAL TO FORM A DIFFUSION COATING

[75] Inventors: Robert A. Rapp; Ge Wang, both of Columbus, Ohio; Endang Pangestuti, Palembang, Indonesia

[73] Assignee: The Ohio State University Research Foundation, Columbus, Ohio

[ * ] Notice: The term of this patent shall not extend beyond the expiration date of Pat. No. 5,492,727.

[21] Appl. No.: 550,108

[22] Filed: Oct. 30, 1995

Related U.S. Application Data

[63] Continuation of Ser. No. 240,350, May 10, 1994, Pat. No. 5,492,727.

[51] Int. Cl.[6] ..... B05D 5/12

[52] U.S. Cl. ..... 427/126.1; 427/252; 427/253; 427/255.1; 427/379

[58] Field of Search ..... 427/126.1, 252, 427/253, 255.1, 379

[56] References Cited

U.S. PATENT DOCUMENTS 5,364,659 11/1994 Rapp et al. ..... 427/253
5,492,727 2/1996 Rapp et al. ..... 427/253

OTHER PUBLICATIONS

Wan, X., Wang, G., and Rapp, R., "Resistance To Aqueous Corrosion Of Steels Protected By A Cr–Si Diffusion Coating," Proceedings of the Seventh Annual Conference on Fossil Energy Materials, May 11–13, 1993 Oak Ridge, Tennessee, pp. 259–268.

*Primary Examiner*—Benjamin Utech
*Attorney, Agent, or Firm*—Kremblas, Foster Millard & Pollick

[57] ABSTRACT

A method for the simultaneous deposition of chromium and silicon to form a diffusion coating on a workpiece uses a halide-activated cementation pack with a dual halide activator. Elemental metal powders may be employed with the dual activator. A two-step heating schedule prevents blocking a chromium carbide from forming at the surface of the workpiece. Small contents of either Ce or V can be added to the Cr+Si contents of the coating by introducing oxides of Ce or V into the filler of the pack.

9 Claims, 4 Drawing Sheets

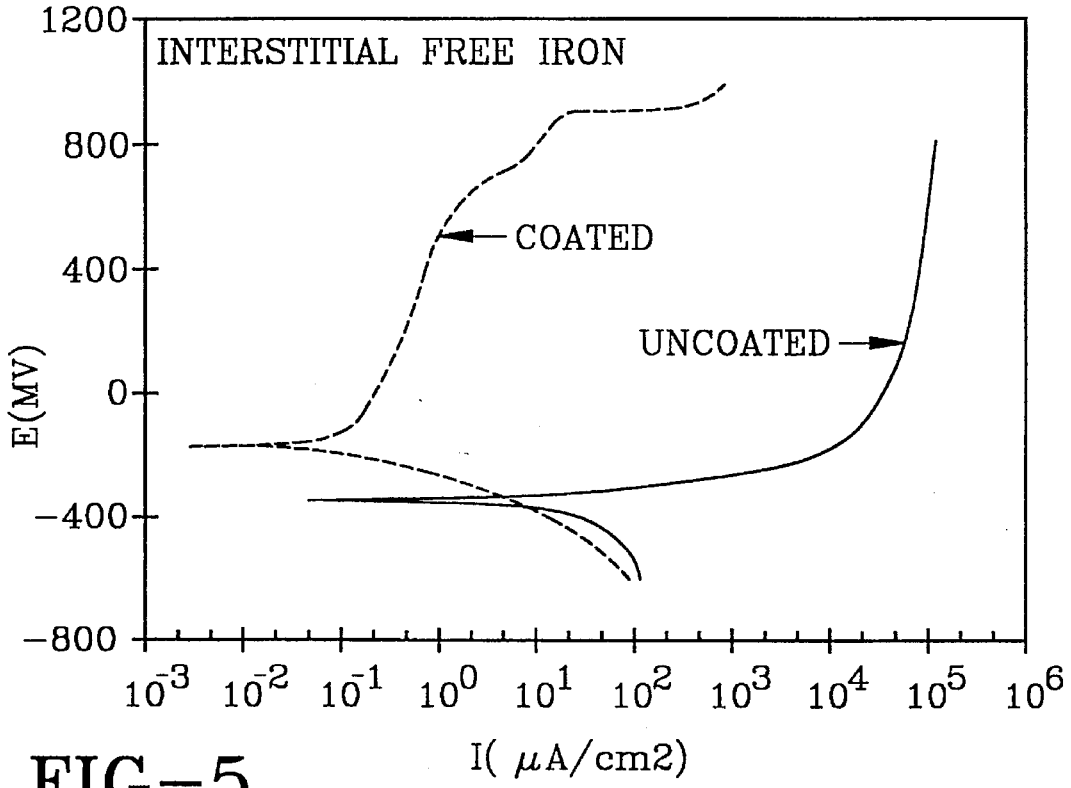
FIG−5
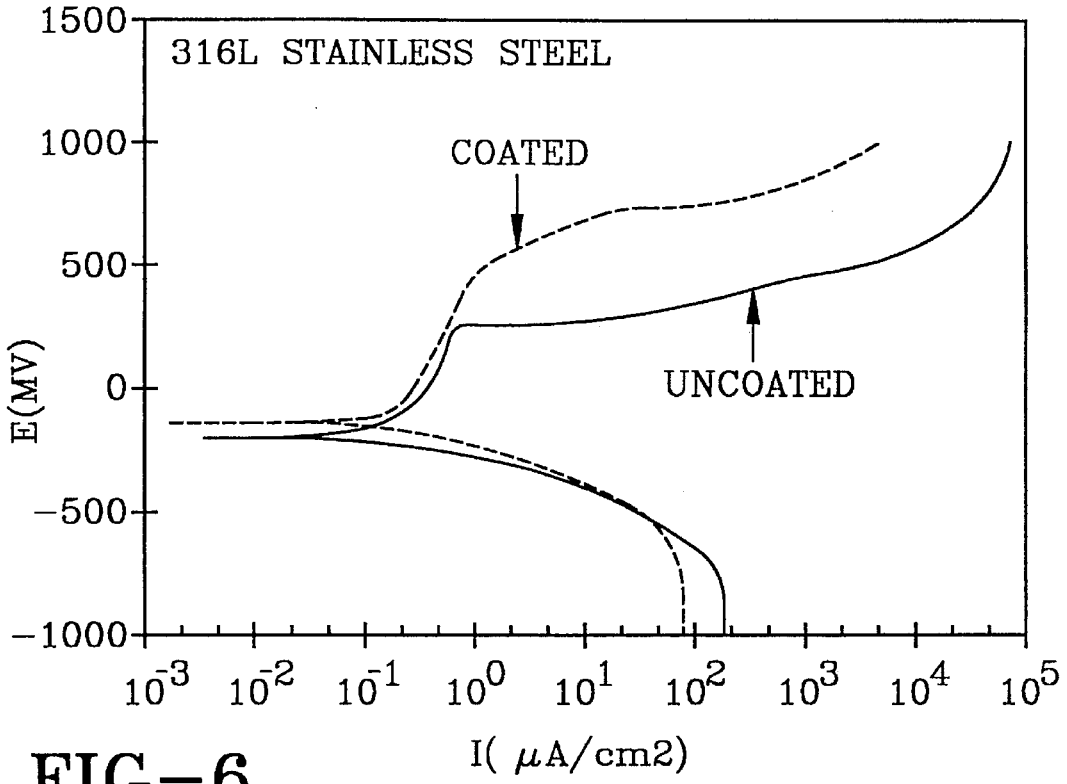
FIG−6

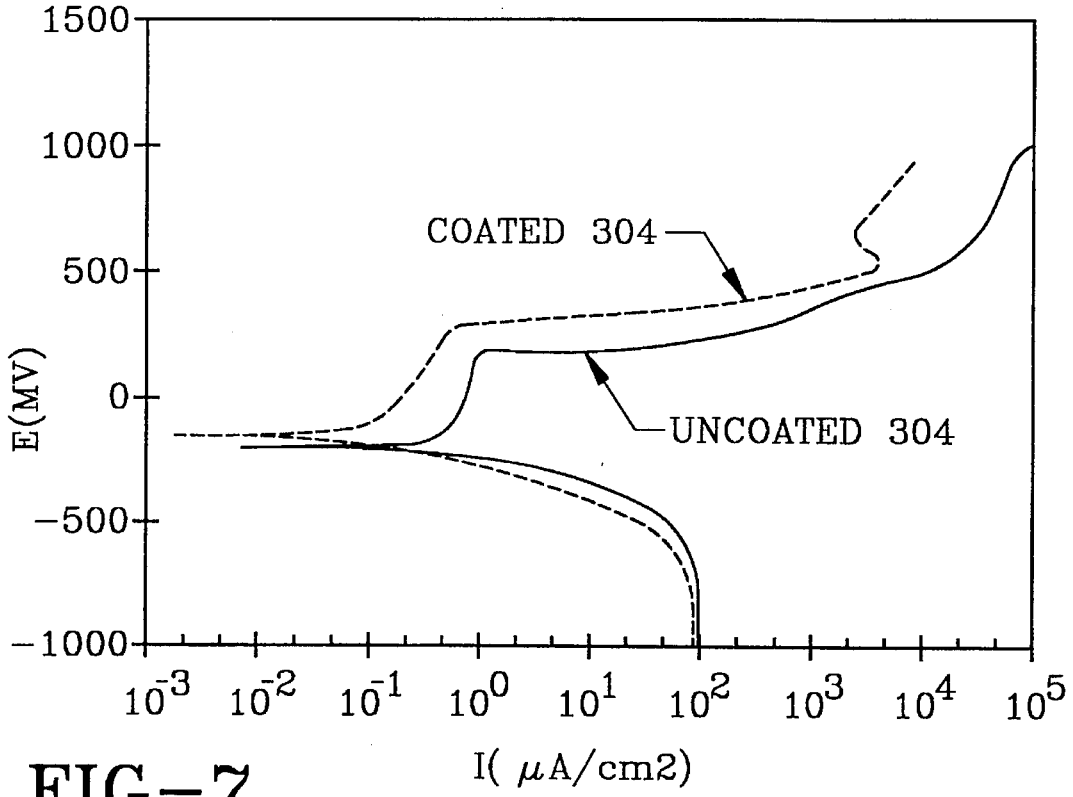
FIG−7
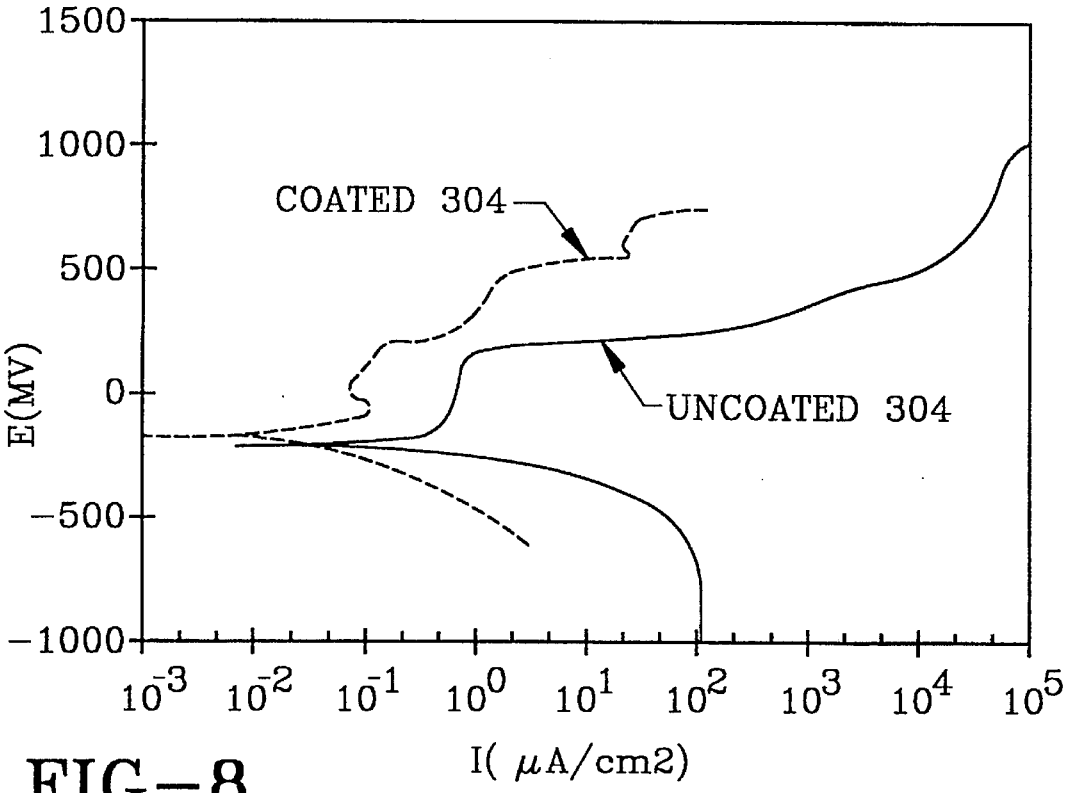
FIG−8

METHOD OF DEPOSITING CHROMIUM AND SILICON ON A METAL TO FORM A DIFFUSION COATING

This application is a continuation of application Ser. No. 08/240,350 filed May 10, 1994, now U.S. Pat. No. 5,492,727, issued Feb. 20, 1996, presently commonly assigned to the assignee of the present application.

BACKGROUND OF THE INVENTION

1. Field of the Invention

The present invention relates in general to a method for the simultaneous deposition of chromium and silicon to form a diffusion coating in metals, and in particular to an improved method for the codeposition of chromium and silicon to form a diffusion coating in steel using dual activator salts.

2. Description of the Related Art

It is known in the field of coating metals or alloys to use a pack cementation process. Basically, a pack cementation process is a modified chemical vapor deposition process which consists of heating a closed or vented pack to an elevated temperature for a specific amount of time during which a diffusional coating is produced on a metal. The closed or vented cementation pack is protected from oxidation by an inert or reducing atmosphere. The cementation pack consists of the metal or alloy member or substrate which is to be coated, surrounded by the elements to be deposited (usually in the form of metal or masteralloy powders), a halide activator salt, and a powder filler. An inert gas, such as argon, or else hydrogen is used to surround the pack. Once the pack is heated to a sufficiently elevated temperature, the activator salt reacts with the metal or masteralloy powder to form metal halide vapors. The metal halide vapors diffuse to the substrate or metal surface through the gas phase of the porous pack. At the substrate surface, a reaction step results in deposition of the desired element and the formation by solid state diffusion of a protective coating at the metal surface. The surface reaction may be somewhat complex, involving adsorption, dissociation, and/or surface diffusion of the molecular species.

In the past, most commercial cementation coating processes have involved the deposition of single elements such as aluminum, chromium or silicon. U.S. Pat. No. 5,364,659 to Rapp et al. describes a method for the codeposition of chromium and silicon diffusion coatings on a steel using a pack cementation process. The specific dual activators of NaF and NaCl were employed to codeposit chromium and silicon to achieve a desired composition (i.e., 25–30 wt. % Cr and 3–4 wt. % Si) in a process that requires an exact control of the fluxes of Cr and Si from the pack to the workpiece during the coating process. This process required the selection of a Cr—Si masteralloy with the desired component activities and a silica filler. The use of the proper ratio of salts as dual activators in combination with the use of a reactive silica filler serves to adjust the partial pressures of chromium chloride and silicon fluoride to set the fluxes of the chromium and silicon into the metal in the right proportion. The foregoing process specifies the use of a Cr—Si masteralloy powder which is expensive and probably cannot be recycled/upgraded. In addition, while the process was successful for relatively low carbon metals, e.g. 2.25 Cr-1Mo-0.15C, an external carbide was formed for higher carbon steels which disrupted the inward diffusion of chromium and silicon. During the process, the substrate was decarburized, thus reducing the strength of the steel. Additionally, the foregoing process did not have any provision for the introduction into the coating of a small concentration (<1%) of a reactive element such as cerium, which is known to provide a number of advantages in scale adherence and reduced sealing kinetics. Likewise, the foregoing process did not have any provision for the introduction of a small vanadium content (≧0.5% V) in the coating. Such a vanadium addition is known to improve the aqueous corrosion resistance.

Accordingly, there is a need for an improved chromium and silicon diffusion coating process which addresses the problem of a blocking chromium carbide layer formed at the surface and which provides a means for the introduction into the coating of a small concentration of reactive element such as cerium, or of vanadium. Preferably, the improved process would use a mixture of powders that is less expensive and incorporate a processing schedule that would not affect the strength of the metal. It is desirable for the improved method to form a coating with a high alloy content on a medium carbon steel or a high strength low alloy steel which could also offer corrosion resistance in oxidizing and corrosive environments at elevated temperatures. Likewise, such coatings offer exceptional resistance to corrosion in aggressive aqueous solutions.

SUMMARY OF INVENTION

The present invention is directed to the aforementioned problems with the prior art as well as others by providing an improved process for the codeposition of chromium and silicon and a minor cerium or vanadium content for the coating of a workpiece. The process employs at least one or two activators and may require (for higher-carbon steels) a two-stage temperature program. The steels are coated to achieve a surface composition with higher chromium and silicon contents and a minor cerium or vanadium content.

Advantageously, the improved process of the present invention uses a mixture of less expensive powders of pure chromium and pure silicon, a single or dual halide activator, a small cerium oxide content (~2%) in the pack (or alternatively, a small vanadium pentoxide content (~2%) in the pack), and perhaps a two-stage heating schedule such that the silicon enters the steel at a lower temperature (about 925° C.) via a halide volatile species to displace the carbon inward. Then, at a higher temperature of about 1150° C., chromium and a minor cerium or vanadium content are supplied for inward diffusion to the workpiece via a volatile chloride species. The combination of a unique pack composition with the two-step temperature program allows the coating of steels with a much higher carbon content than heretofore, resulting in surface compositions having higher silicon contents.

An object of the present invention is to provide a process for the codeposition of a chromium and silicon plus cerium or plus vanadium diffusion coating in the surface of a metal.

Another object of the present invention is to provide a codeposition process which avoids the formation of blocking chromium carbide at the surface.

Still another object of the present invention is to provide a process for codeposition of chromium and silicon that uses elemental chromium and silicon powders which are less expensive than a masteralloy.

The various features of novelty which characterize the invention are pointed out with particularity in the claims annexed to and forming a part of this disclosure. For a better understanding of the invention, its operating advantages and specific objects attained by its use, reference is made to the accompanying drawings and descriptive matter in which the preferred embodiment of the invention is illustrated.

BRIEF DESCRIPTION OF DRAWINGS

In the drawings:

FIG. 5 is a graph illustrating electrochemical polarization behavior of interstitial-free iron coated to increase Cr and Si contents plus Ce tested in a 0.6M NaCl/0.1M $Na_2(SO_4)$ solution (pH=8) at room temperature, compared to an uncoated alloy.

FIG. 6 is a graph illustrating electrochemical polarization behavior of 316L stainless steel contents plus Ce tested in a 0.6M NaCl/0.1M $Na_2(SO_4)$ solution (pH=8) at room temperature, compared to an uncoated alloy.

FIG. 7 is a graph illustrating potentiodynamic curves for a coated 304 stainless steel coupon coated to achieve the surface composition with the following surface composition: 35.8Cr-2.9Si-5.87Ni with Ce added, compared to an uncoated alloy.

FIG. 8 is a graph illustrating potentiodynamic curves for a 304 stainless steel coupon coated to achieve the surface composition with the following surface composition: 48.9Cr-3.67Si-4.9Ni-0.64V compared to an uncoated alloy.

DESCRIPTION OF THE PREFERRED EMBODIMENT

Figure 1:
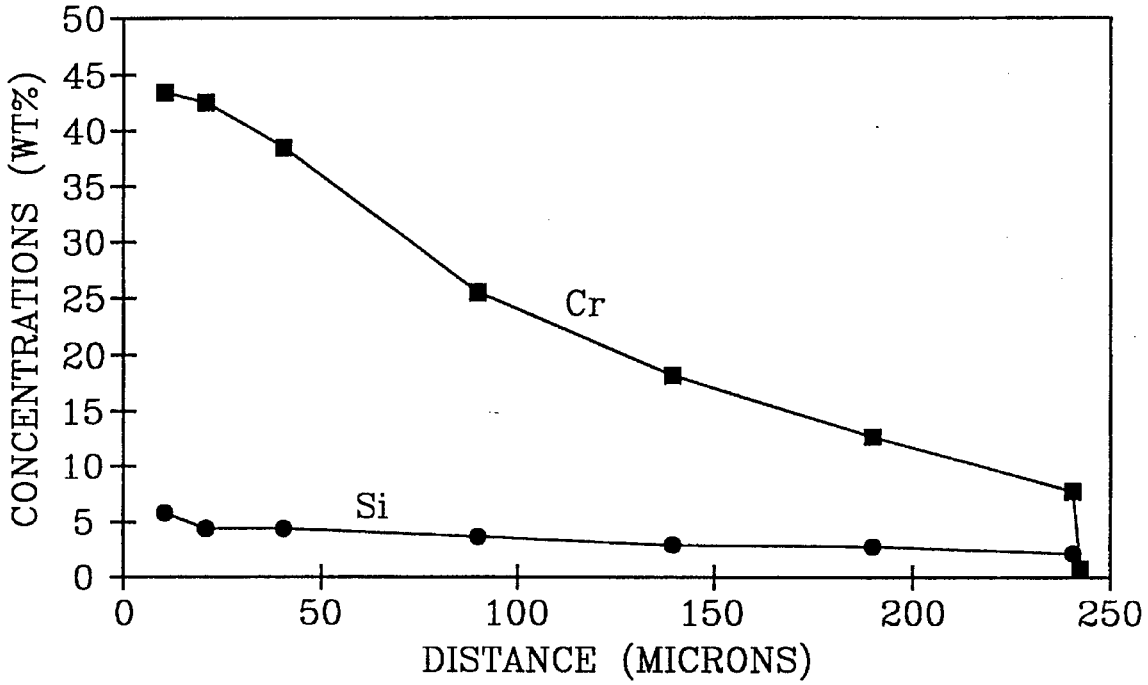
FIG. 1 is a plot of concentration in weight percent for chromium (Cr) and silicon (Si) versus distance from the surface in microns for a coating on interstitial-free steel using 20 wt. % Cr-2%Si mixed pure powders with 2 wt. % ($90MgCl_2$-10NaF) activators diffused at 11500° C. for 8 hours ($Al_2O_2$ filler plus 2% $CeO_2$)

The present invention resides in an improved process for the simultaneous deposition of chromium and silicon plus cerium or vanadium to form a diffusion coating on the steels. The present invention finds particular utility in the codeposition of chromium and silicon plus cerium or vanadium on medium carbon and high strength low alloy (HSLA) steels, but is also applicable to other metals including low carbon steels. The term low carbon is meant to include a metal having less than or equal to 0.2% C on a weight percent basis; medium carbon is meant to include 0.5% C on a weight percent basis; and high carbon is greater than or equal to about 0.5% C on a weight percent basis. All percentages used herein are meant to be on a weight percent basis.

The growth of a ferritic Cr—Si diffusion coating by pack cementation on a medium carbon steel encounters two major problems. First, the codeposition of Cr and Si to achieve the desired composition, i.e., 25–30 wt. % Cr and 3–4 wt. % Si, requires an exact control of the fluxes of Cr and Si from the pack to the steel during the coating process. Second, to avoid the formation of chromium carbide at the surface, the carbon activity and its flux in the metal to the surface must be minimized. To solve the first problem, a dual activator process different from that first described in U.S. Pat. No. 5,364,659 to Rapp et al. is adopted here. After selection of mixed pure Cr and Si powders with the desired component amounts, the use of a proper ratio of certain salts as a dual activator can serve to adjust the partial pressures of chromium chloride and silicon fluoride, thus setting the fluxes of the volatile Cr and Si halides to the steel in the right proportion. To solve the second challenge, i.e., avoiding a blocking Cr carbide at the surface, a two-stage heatup scheme may be introduced into this improved process. Because of its higher vapor pressure at the intermediate temperature, $SiF_X$ vapors preferentially deposit silicon and initiate a ferrite layer with low carbon solubility. The strong thermodynamic repulsion between silicon and carbon hence serves to reject carbon inwards, thereby preventing chromium carbide formation at the surface during the later high temperature step when chromium and cerium or vanadium is deposited. Also, because silicon is a ferrite stabilizer, the initial phase transformation from austenite to ferrite at the surface greatly reduces the surface carbon content to eliminate carbide formation.

Additionally, the present invention replaces the $SiO_2$ filler from the foregoing patent application with $Al_2O_3$ plus about 2 wt % $CeO_2$ or 2 wt % $V_2O_5$. This replacement permits easier unloading of the pack, it reduces decarburization of the steel substrates and it permits the introduction of a small cerium or vanadium content into the coating.

The method of the present invention extends the earlier method described in U.S. Pat. No. 5,364,659 to Rapp et al. to develop similar coatings for medium carbon steels such as AISI 1045 and high-strength, low-alloy (HSLA) steels such as AISI 4340 steel. Advantageously, the improved method of the present invention uses elemental Cr and Si powders which are less expensive and more readily recyclable than Cr—Si masteralloy and permits an introduction of cerium or vanadium to the coating, and also minimizes substrate decarburization.

Table I presents the coating characteristics for packs with a mixture of elemental Cr and Si powders using at least one activator and heating schedule for these coatings. The surface compositions were consistently around 25–35 wt % Cr and 3.5 wt % Si. The cementation packs using higher silicon contents often resulted in a slightly higher silicon content in the coatings.

TABLE I

| Substrate | Activator(s) (wt %) | Metal Sources | Filler | Surface Comp. (wt. %) |
|---|---|---|---|---|
| I.F. Iron | $2MgCl_2$ | 2Si—20Cr | $Al_2O_3$ | 50.3Cr—3.9Si |
| I.F. Iron | 2NaCl | 2Si—20Cr | $Al_2O_3$ | 33.6Cr—5.3Si |
| I.F. Iron | $2NH_4Cl$ | 2Si—20Cr | $Al_2O_3 + CeO2$ | 47.4Cr—1.8Si—0.3Ce |

TABLE I-continued

| Substrate | Activator(s) (wt %) | Metal Sources | Filler | Surface Comp. (wt. %) |
|---|---|---|---|---|
| I.F. Iron | 2(90$MgCl_2$10NaF) | 2Si—20Cr | $Al_2O_3$ + $CeO_3$ | 43.5Cr—5.2Si + Ce |
| T11 | 2(90$MgCl_2$10NaF) | 2Si—20Cr | $Al_2O_3$ + $CeO_2$ | 19.5Cr—3.5Si + Ce |
| 4340 | 2(90$MgCl_2$10NaF) | 2Si—20Cr | $Al_2O_3$ | 24.9Cr—3.7Si |
| 316L | 2(90$MgCl_2$10NaF) | 2Si—20Cr | $Al_2O_3$ + $CeO_2$ | 38.9Cr—3.89Si + Ce |
| 304 | 2(90$MgCl_2$10NaF) | 2Si—20Cr | $Al_2O_3$ + $CeO_2$ | 35.8Cr—3.86Si + Ce |
| 304 | 2(90$MgCl_2$10NaF) | 2Si—20Cr | $Al_2O_3$ + $2V_2O$ | 48.9Cr—3.67Si—0.64 V |

EXPERIMENTAL EXAMPLES

AISI 4340 steels were cut into coupons of approximately 2×1×0.2 cm by a low-speed diamond saw. The coupons were ground through 600 grit SiC abrasive paper, and cleaned ultrasonically in water and then in acetone. The exact dimensions and weight of each coupon were then measured.

One kind of pack involved a 20 wt % mixture of elemental Cr and Si powders of 90Cr-10Si proportion, and 2 wt % of a dual activator mixture of approximate composition 90$MgCl_2$-10NaF, along with the $Al_2O_3$ filler (no $CeO_2$ added).

In each case, a set of 2 to 4 cleaned coupons was uniformly embedded in a pack mixture inside an alumina crucible. The charged crucible was dried in an oven at about 100° C. for about an hour. The crucible was then covered by an alumina lid and sealed bye high temperature ceramic cement. The sealed crucible was cured at about 100° C. for another hour, and then positioned inside a horizontal alumina tube which was heated by an electrical resistance furnace. A type K thermocouple was placed in direct contact with the sealed crucible for monitoring and controlling the process temperature. During the heating, high-purity argon was purged through the entire system to prevent oxidation. After heating at the desired temperatures (about 925° C. about 1150° C.) for various times, the crucible was furnace-cooled to room temperature.

The coated coupons were cleaned ultrasonically, and their dimensions and weights were recorded. Some of the coupons were X-rayed and then mounted, sectioned, ground and polished for metallographic examination. The polished mounts were etched with 10% nital solution, and examined by an optical microscope. The compositions of the coatings were determined using Energy Dispersive Spectroscopy (EDS) on a JEOL-JXA-35 scanning electron microscope (SEM). The spectroscope was calibrated weekly and the quantitative analysis was made by comparing against a standard alloy specimen whose composition was established by NIST.

Figure 2:
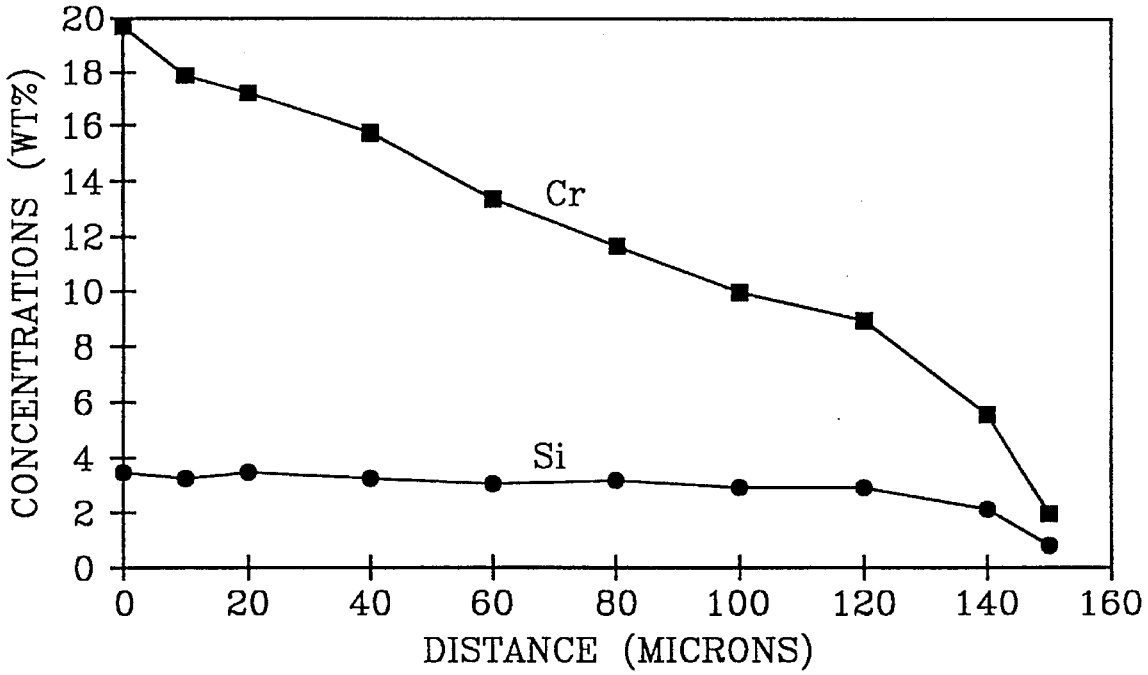
FIG. 2 is a plot as similar to FIG. 1 for a coating on T11 steel using similar materials with a similar activator and the same temperature schedule.

FIGS. 1 and 2 present representative coating composition profiles for an interstitial-free steel and a T11 steel, respectively. For these coatings, mixed pure Cr and Si powders (90Cr-10Si) and a dual activator of 2 wt. % 90$MgCl_2$-10NaF were used without any hold at the intermediate temperature. $Al_2O_3$ plus $CeO_2$ was used as the filler. This simpler heating schedule was adequate because the steels of FIGS. 1 and 2 contained low carbon.

Figure 3:
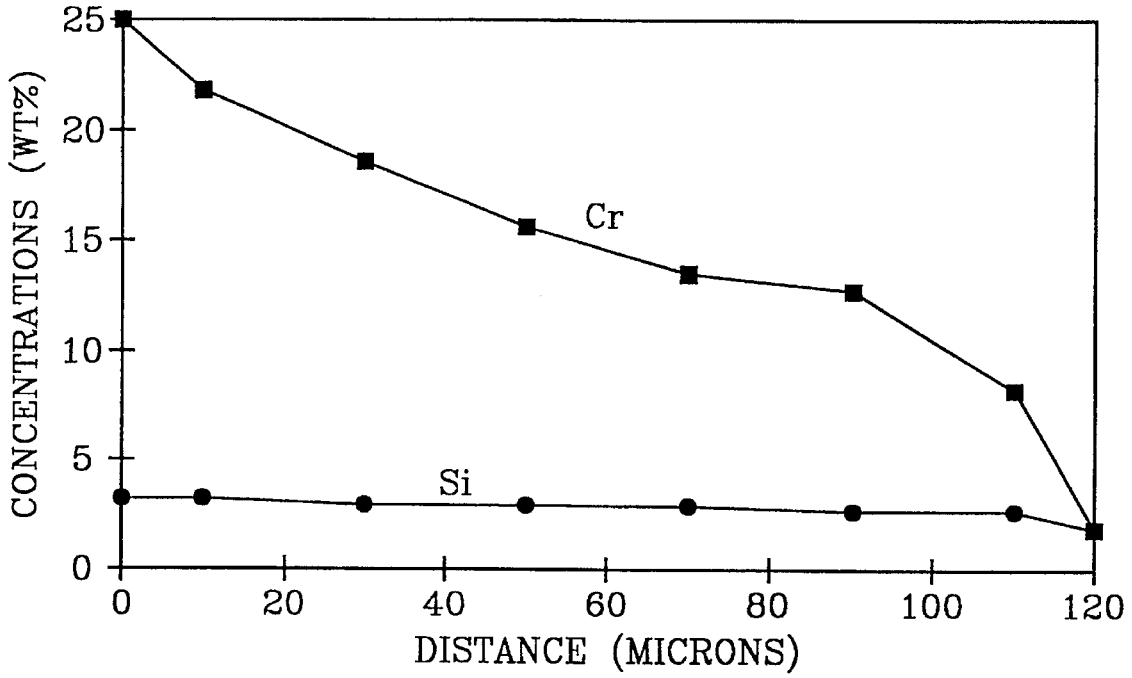
FIG. 3 is a plot as before for a coating on 4340 steel using similar materials with similar activators diffused at 925° C. for 8 hours then at 1150° C. for 4 hours ($Al_2O_3$ filler)

FIGS. 3 shows the composition profiles for a 4340 steel. In this case, the coating pack consisted of a mixture of Cr and Si elemental powders (20 wt. % Cr+2 wt. % Si) and the dual salt activator 2 wt. % (90$MgCl_2$-10NaF) with an $Al_2O_3$ filler.

For all of the three coatings, the introduction of both Cr and Si at the high temperature stabilized a ferrite surface layer on the austenite interior. Upon rather slow cooling, the interior converted to ferrite plus carbide, and indeed, the ferrite gains of the coating grew inward to eliminate the coating/core interface which existed at the high temperature. Thus, in most cases, the ferrite grains of the coating extend into the substrate or workplace, providing an excellent bond for the coating to the substrate.

Based upon the foregoing experimental studies, it was determined that the greatest difficulties in chromizing medium-carbon steels at high temperatures are the formation of a blocking chromium carbide at the surface and decarburization of the substrate. This chromium carbide layer reduces greatly the diffusion of chromium into the substrate or workplace, except after extended heating at a relatively high temperature (about 1150° C.). The preliminary introduction of a carbon-repulsive and ferrite-stabilizing third element, e.g. Si, into the coating greatly reduces the carbon activity in the coating and therefore retards the formation of chromium carbide at the surface.

Previous work as taught in U.S. Pat. No. 5,364,659 suggests that in a dual activator Cr—Si cementation pack, chlorine primarily increases the vapor pressure of chromium chloride gaseous species, whereas fluorine primarily increases the vapor pressures of silicon fluoride gaseous species. Therefore, by adjusting the ratio between chloride and fluoride in a two activator approach, one can achieve different proportions of chromium and silicon content in the coating.

Chromium-silicon coatings show good resistance to high temperature oxidation attack generally and have a smooth surface finish.

Figure 4:
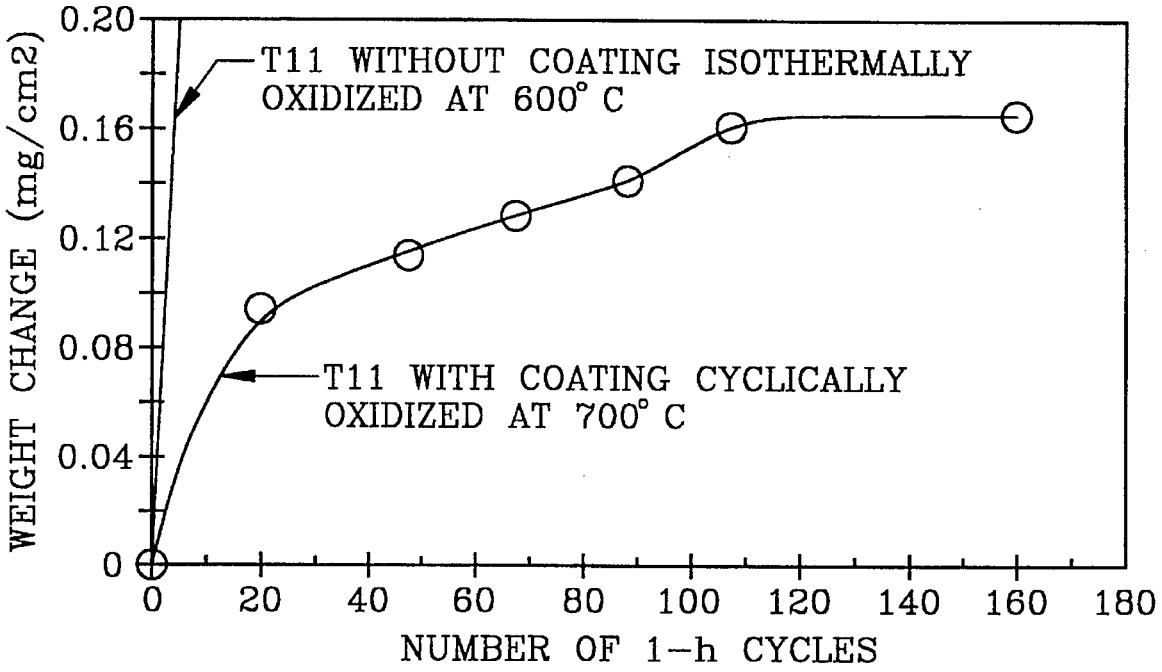
FIG. 4 is a graph of the weight gain for a coated T11 coupon with concentration profiles such as shown in FIG. 2 oxidized in air at 700° C. with periodic one-hour thermal cycles. Comparison is made to the weight gain kinetics for an uncoated T11 coupon oxidized isothermally at 600° C. (Ref. 2).

FIG. 4 presents the weight-gain for a chromized-siliconized (plus Ce) coupon of T11 oxidized in air at 700° C. with intermittent cooling at 1 hour cycles. Following a small initial weight-gain of about 0.1 mg/$cm^2$ after 20 cycles, greatly reduced kinetics were recorded. At steady state (after 100 cycles) an extremely low oxidation rate is observed. The isothermal oxidation kinetics for uncoated T11 steel in air at 600° C. are plotted for comparison.

The preferred two-step heating process for a medium-carbon steel is a hold at about 925° C. for about 8 hours followed by heating to a temperature of about 1150° C. and holding for about 4 hours. The temperature arrest at abut 925° C. could be avoided if the pack were very slowly heated to temperature as in an industrial furnace, or if only low-carbon steels are coated.

Advantages of the improved process include the use of a mixture of elemental powders that are less expensive than a masteralloy powder. Also, spent powders for this process could be rejuvenated by the simple addition of more pure powders after a run. Unlike other processes, this process is suited for codepositing chromium and silicon in higher carbon steels.

The same coating principle was also applied to improve the aqueous corrosion resistance of interstitial-free iron and stainless steels. FIG. 5 shows the electrochemical polarization curves of the interstitial-free iron in a 0.6M NaCl/0.1M $Na_2SO_4$ solution at room temperature, measured without and with a chromizing/siliconizing plus cerium coating. The coated steels developed a very distinct passive plateau to reach a very high pitting potential compared to art uncoated steel. Such electrochemical test data are known in the art to correspond to excellent corrosion resistance, especially to localized corrosion (pitting, crevice, etc.). Such behavior would also be expected for similarly coated low and medium carbon steel. FIG. 6 shows the electrochemical polarization curve for a 316L stainless steel in a 0.6M NaCl/0.1M $Na_2SO_4$ solution at room temperature, measured without and with a chromizing/siliconizing plus Ce coating. The coated steels exhibit much higher transpassive potential (pitting potential) and a wider passivation region than the original steels. Such electrochemical test data are known to correspond to improved corrosion resistance, especially to localized corrosion.

In FIG. 7, the combination of Cr and Si with an addition of Ce gave significant improvement to the electrochemical behavior of 304 stainless steel. In the anodic polarization of 304, the passive current density was reduced over a quite large range, compared to an uncoated 304 specimen, due to the effect of adding cerium to the Cr+Si. Such electrochemical test data are known to correspond to improved corrosion resistance, especially to localized corrosion.

In FIG. 8, the combination of added Cr and Si with an addition of vanadium to 304 stainless steel is shown to greatly improve the electrochemical polarization behavior compared to an uncoated 304 specimen. Vanadium plays a role in extending the passive region and reducing its current density and it should improve the resistance to localized corrosion. The aqueous test solutions for FIGS. 7 and 8 were the same as those for FIGS. 5. and 6.

What is claimed is:

1. A method for forming a diffusion coating by depositing chromium and silicon on an iron-based substrate comprising the steps of:

(a) placing a cementation pack in surrounding relationship to a surface of the substrate, the cementation pack including a mixture of essentially pure chromium powder and essentially pure silicon powder, at least one halide salt activator, and an alumina filler;

(b) heating the substrate and cementation pack in an inert or reducing atmosphere to a first temperature sufficient to cause vaporization of the halide salt and for a time sufficient to cause the preferential deposition of essentially silicon on the surface of the substrate; and then (c) heating the substrate and cementation pack to a second, higher temperature for a time sufficient to cause the deposition of predominantly chromium on the surface of the substrate.

2. A method in accordance with claim 1, wherein the first temperature is held substantially constant for about 8 hours and the second temperature is held substantially constant for about 4 hours.

3. A method in accordance with claim 1, wherein the halide salt activator includes sodium fluoride and magnesium chloride.

4. A method in accordance with claim 1, wherein the cementation pack includes up to about 2 weight percent of a compound selected from the group consisting of cerium oxide and vanadium pentoxide.

5. A method for forming a diffusion coating by depositing chromium and silicon on an iron-based substrate comprising the steps of:

(a) placing a cementation pack in surrounding relationship to a surface of the substrate, the cementation pack including a mixture of essentially pure chromium powder and essentially pure silicon powder, at least one halide salt activator and an alumina filler; and (b) heating the substrate and cementation pack in an inert atmosphere through a temperature range between about 925° C. and 1150° C. at a rate sufficient to cause the deposition of an initial compound consisting essentially of silicon on the surface of the substrate in a lower region of the temperature range, and the subsequent deposition of a predominantly chromium compound on the surface of the substrate in a higher region of the temperature range.

6. A method in accordance with claim 5, wherein the rate of heating is sufficient to cause the deposition of silicon on the substrate to initiate the formation of a ferrite layer at the substrate surface prior to the subsequent deposition of a substantial amount of chromium on the substrate.

7. A method in accordance with claim 5, wherein the total heating time is about 12 hours.

8. A method in accordance with claim 5, wherein the halide salt activator includes sodium fluoride and magnesium chloride.

9. A method in accordance with claim 5, wherein the cementation pack includes up to about 2 weight percent of a compound selected from the group consisting of cerium oxide and vanadium pentoxide.

* * * * *

UNITED STATES PATENT AND TRADEMARK OFFICE

CERTIFICATE OF CORRECTION

PATENT NO. : 5,589,220

DATED : Dec. 31, 1996

INVENTOR(S) : Rapp et al.

It is certified that error appears in the above-indentified patent and that said Letters Patent is hereby corrected as shown below:

Column 3, line 13, "11500° C." should read --1150° C.--; line 15, delete "as". Spanning Columns 5 and 6, in Table I, line 9, "35.8Cr-3.86Si + Ce" should read --35.8Cr-2.86Si + Ce--. Column 5, line 27, "bye" should read --by a--. Column 6, line 12, "gains" should read --grains--; line 15, "workplace" should read --workpiece--; line 23, "workplace" should read --workpiece--; line 53, "abut" should read --about--. Column 7, line 4, "art" should read --an--.

Signed and Sealed this

Twenty-second Day of April, 1997

Bruce Lehman

*Attest:*

BRUCE LEHMAN

*Commissioner of Patents and Trademarks*

*Attesting Officer*